US007968173B2

(12) United States Patent
Vast et al.

(10) Patent No.: US 7,968,173 B2
(45) **Date of Patent: *Jun. 28, 2011**

(54) SHEET WITH A COPY-RESISTANT REGION OF REDUCED OPACITY

(75) Inventors: Nathalie Vast, Verrieres le Buisson (FR); Yvan Thierry, Jouy sur Morin (FR); Stephane Mallol, Provins (FR)

(73) Assignee: Arjowiggins Security, Paris (FR)

( * ) Notice: Subject to any disclaimer, the term of this patent is extended or adjusted under 35 U.S.C. 154(b) by 1065 days.

This patent is subject to a terminal disclaimer.

(21) Appl. No.: 10/541,202

(22) PCT Filed: Dec. 23, 2003

(86) PCT No.: PCT/FR03/03874

§ 371 (c)(1),
(2), (4) Date: May 10, 2006

(87) PCT Pub. No.: WO2004/062941

PCT Pub. Date: Jul. 29, 2004

(65) Prior Publication Data

US 2006/0240226 A1 Oct. 26, 2006

(30) Foreign Application Priority Data

Jan. 2, 2003 (FR) ..... 03 00017

(51) Int. Cl.
*B41M 5/00* (2006.01)

(52) U.S. Cl. ..... 428/195.1; 917/916; 283/72; 283/57; 283/77; 283/91; 283/92; 283/93; 283/94; 283/58; 430/10; 430/301; 430/302; 430/303; 430/304; 430/305; 430/306; 430/307; 430/308; 358/405; 358/374; 358/454; 358/533; 356/604; 356/608; 356/636

(58) Field of Classification Search ..... 428/195.1, 428/917, 916; 283/72, 57, 77, 91–94, 58; 430/10, 301–308; 358/405, 374, 454, 533; 356/604, 608, 636
See application file for complete search history.

(56) References Cited

U.S. PATENT DOCUMENTS

| | | | | |
|---|---|---|---|---|
| 4,766,026 | A * | 8/1988 | Lass et al. | 428/203 |
| 6,494,491 | B1 * | 12/2002 | Zeiter et al. | 283/91 |
| 6,991,260 | B2 * | 1/2006 | Fan et al. | 283/72 |
| 6,991,846 | B2 | 1/2006 | Mallol et al. | |
| 6,997,482 | B2 * | 2/2006 | Mathys | 283/72 |
| 7,429,062 | B2 * | 9/2008 | Fan et al. | 283/72 |
| 2005/0244720 | A1 * | 11/2005 | Doublet | 430/1 |

FOREIGN PATENT DOCUMENTS

| | | |
|---|---|---|
| EP | 1 122 360 A1 | 8/2001 |
| EP | 1122360 B1 | 8/2001 |
| WO | WO 00/43216 | 7/2000 |

OTHER PUBLICATIONS

Patent Abstracts of Japan, Publication No. 2000290896, published on Oct. 17, 2000.

* cited by examiner

*Primary Examiner* — Bruce H. Hess
*Assistant Examiner* — Tamra L. Amakwe
(74) *Attorney, Agent, or Firm* — Westerman, Hattori, Daniels & Adrian, LLP

(57) ABSTRACT

The present invention relates to printable security paper that includes a region capable of receiving printed indicia on the front side and on the reverse side which are observable in reflected light and form an image observable in transmitted light, as security element protecting against two-sided copying, characterized in that such region is a screened region having an average overall opacity less than the opacity of the vellum part of the rest of the paper, said screened region being made up from alternations of vellum miniregions, having an approximately constant thickness equal to that of the vellum part of the rest of the paper, and of miniregions of reduced opacity because of their smaller thickness compared with the vellum miniregions. The invention also relates to the security document obtained with this paper.

25 Claims, No Drawings

SHEET WITH A COPY-RESISTANT REGION OF REDUCED OPACITY

The invention relates to a security paper that includes a region of reduced opacity made from a screen and capable of receiving printed patterns, especially on both sides of the paper, which printed patterns can be complementarily observed in transmitted light as a security element for protection against two-sided copying. It also relates to the security document protected against two-sided copying, having said paper as medium.

To combat the counterfeiting of banknotes by two-sided photocopying or using a scanner and a printer, patterns on the front side and on the reverse side of the banknote have been produced, by suitable registration in a given region, so that these patterns combine to form a final image or representation, for example a set of graphical lines or alphanumeric characters or an image of a person or animal, etc. When the banknote is viewed in reflected light, only the pattern produced on the observed face is seen whereas, when the banknote is observed in transmitted light, all the patterns that therefore combine to give the final representation are seen. According to a variant, identical patterns are produced on the front side and on the reverse side so as to observe, in transmitted light, an image that is also identical to the patterns, which are superposed. These patterns are formed by printed indicia of flat tint or printed indicia consisting of lines or other shapes.

A person skilled in the art refers to these by English term as "see-through" indicia or alternatively as "print-through" indicia.

Certain banknotes have a weight and an opacity that are sufficiently low to allow these patterns to be observed provided that the printed indicia are of flat tint and/or not too fine. It has been the intention to apply these indicia to security documents having a higher weight and/or higher opacity. The problem of observing the presentation in transmitted light was then encountered. To remedy this problem, European patent application EP0388090 proposed to print these indicia in a region of reduced opacity, this region being produced specifically by a watermark obtained in a conventional manner, that is to say using an embossed watermarking wire for a cylinder mold paper machine or else an embossed watermarking roll for a Fourdrinier machine.

The problem that then arose was how to obtain a uniform region of reduced opacity and large area so as to be able to produce patterns of sufficiently large size, the process with the conventional watermark regions allowing only uniform regions of small area to be obtained.

It was then proposed, in patent application EP687324, to produce a region of reduced thickness and reduced opacity with an area of more than 0.4 $cm^2$ by providing a two-ply paper, one ply of which has a region of reduced or even zero thickness. The latter means is limited to two-ply paper and the region is quite fragile. Security papers, especially banknotes, are subjected to intense handling in circulation, consequently they must have a high resistance to circulation and therefore a high mechanical strength.

Moreover, the means for reproducing the patterns, such as photocopiers and scanners, allow two-sided color copying and have the capability of ever finer resolution; it is therefore endeavored to produce patterns that are more difficult to counterfeit.

However, the Applicant has found that, at the present time, indicia made from flat tints are the most widely used, but are also relatively easy to reproduce by two-sided color photocopiers or scanners. For example, current banknotes of the new European Community currency, namely euros, have, in one of their corners, on both sides of the banknote, printed indicia of flat tint with the dominant color of said banknote, which indicia form the value of the banknote when it is observed by being held up to the light. These indicia are not made in a region of reduced opacity, the opacity of the banknote allowing them to be observed. The areas of flat tint are quite coarse and could be quite easy to reproduce.

Current papers do not allow patterns to be made with sufficient fineness and/or complexity to effectively combat their reproduction, the regions of reduced opacity proposed hitherto having an opacity that is too high to allow very fine lines to be observed and/or not being of sufficient area to be able to print patterns of quite large size and/or being too fragile to withstand circulation.

The aim of the Applicant is therefore to propose a security paper allowing more complex and/or finer patterns to be produced and observed.

The aim of the invention is therefore to propose a paper that makes it possible to observe two-sided printed indicia that are more complex and/or finer than at the present time, so as to be difficult to reproduce, the mechanical properties of the paper, which are necessary for its use, being sufficient and also the region in which these patterns are printed being of quite a large area.

The Applicant has found that the aims of the invention are achieved by proposing a security paper that includes a region of reduced overall opacity and which is a screened region made up of an alternation of small regions of reduced opacity, by thickness reduction, and of small vellum regions which, because of their number density (i.e. their number per unit area), keep the mechanical strength of said screened region at a level sufficient to retain characteristics for the normal use of the paper.

The invention therefore proposes a printable security paper comprising a region capable of receiving printed indicia on the front side and on the reverse side which are observable in reflected light and form an image observable in transmitted light, as security element protecting against two-sided copying, characterized in that such region is a screened region having an average overall opacity less than the opacity of the vellum part of the rest of the paper, said screened region being made up from alternations of vellum miniregions, having an approximately constant thickness equal to that of the vellum part of the rest of the paper, and of miniregions of reduced opacity because of their smaller thickness compared with the vellum miniregions. The mechanical strength of said screened region is sufficient to retain characteristics suitable for the normal use of the paper.

Advantageously, the invention makes it possible to provide a paper with at least one region of reduced opacity, but the total area of which may be large, and the size will be chosen according to the size of the final document and to the patterns that it is desired to produce. The total area of said screened region may for example be 1 $cm^2$, but it may be larger or smaller. The smallest dimension of said region may be relatively large if necessary—in particular it is at least 0.5 cm. A region with a smaller dimension, for example from 1 to 5 cm, may be readily produced.

Said screened region has any shape, for example circular, rectangular, square or star-shaped.

According to one particular case, the screened region and/or the screen itself of said region may represent a particular design, such as a customized design forming a letter or a collection of letters, possibly characteristic of the issuer of the security document that will be made from the paper according to the invention, or else a design that corresponds to that of the final representation, resulting from the patterns that will be printed on both sides.

Said screened region can be printed on both sides, especially by offset printing and intaglio printing.

Said screened region is preferably produced by a screening watermarking process as described in patent application EP1122360.

This paper watermarking process uses a wire employed during the wet phase of paper manufacture, the wire being provided with a set of masks which create, in one region of the paper lying opposite the masks during formation of the paper, a set of miniregions of reduced thickness, and therefore of reduced opacity, which are formed in the thickness of the paper, the regions between these miniregions forming vellum miniregions. The masks present on the wire limit the accumulation of the constituents, cellulose fibers, cotton fibers, synthetic fibers, such as polyolefin or polyester fibers, mineral fibers, these possibly being filled, of the aqueous suspension for manufacturing the paper; these masks form the miniregions of reduced thickness. The vellum miniregions, formed between the miniregions of reduced thickness resulting from the masks of the grid, have a thickness substantially equal to that of the vellum part of the rest of the paper, that is to say away from the screened region and away from other security elements or printed indicia.

In a first embodiment of the invention, the wire in question constitutes the paper-forming wire.

In a second embodiment, the wire in question serves for picking-up the sheet formed.

In a third embodiment, the wire in question is fastened to a wet press, which works the still-wet sheet after it is picked-up.

In a fourth embodiment, the wire in question is fastened to a dandy roll.

In a fifth embodiment of the invention, the wire in question is fastened to a graining element located away from the sheet-forming region.

The wire may, for example, be on a cylinder mold paper machine or on a Fourdrinier machine.

In each of the embodiments described above, the set of masks may be on the internal face of the wire, within its thickness, or on the external face of the wire, several wires possibly being combined.

Preferably, the array of masks lies on one of the faces of the wire rather than within its thickness.

Of course, any combination of the embodiments described above is also possible.

Various embodiments of the set of masks will now be described.

In a first embodiment, the set of masks is formed by a one-piece grid, obtained from a thin sheet, in which apertures, for example circular apertures, have been made and arranged in a regular or irregular array, depending on the desired visual effects. Those parts of the grid remaining between the apertures constitute the masks of the array.

The number density (i.e. the number per unit area) of apertures and their size are determined by a person skilled in the art depending on the weight of the paper, on its composition and on the desired variation in opacity between said screened region and the vellum part of the rest of the paper and on the desired visual effect. Experiments have shown that the aperture density/aperture size pair is a key factor as regards the overall opacity of said screened region.

Preferably, an array of masks with the largest possible number of apertures will be chosen, these apertures being small. This is because, after the many tests performed by the Applicant, it seems that such an array makes it possible to obtain a paper with a screened region having a reduced overall opacity optimized for the production and observation of very fine copy-resistant patterns. The following opacity measurements were taken according to the ISO 2471 standard on a ELREPHO 2000 spectrophotometer.

By way of one particular example, circular apertures with a diameter of 0.8 mm in a circular metal plate 1.5 cm in diameter and with a density of 55 per $cm^2$ resulted in the formation of a screened region in a cellulose paper having an opacity difference of 9.4 points between the average overall opacity of said region and the opacity of a vellum part of the rest of the paper.

According to another particular example, circular apertures with a diameter of 0.39 mm in a circular metal plate 1.5 cm in diameter and with a density of 115 per $cm^2$ resulted in the formation of a screened region in a cellulose paper having an opacity difference of 21 points between the average overall opacity of said region and the opacity of a vellum part of the rest of the paper.

However, measures have to be taken to ensure that the screened region maintains good mechanical strength. After these many tests, the Application estimates that an opacity difference of between 5 and 12 points, preferably between 6 and 10 points, between the average overall opacity of said region and the opacity of a vellum part of the rest of the paper makes it possible to maintain a mechanical strength suitable for the paper to be able to withstand the various stresses associated with circulation, especially in the case of banknotes, the opacity having been measured according to the ISO 2471 standard.

In a second embodiment, the set of masks is formed by a juxtaposition of small pieces fixed individually to the wire.

In one particular embodiment, the masks are, at least in part, given a particular shape intended to customize the sheet of paper, creating, within the thickness of the latter, miniregions reproducing the pattern of the masks. For example, each pattern may form a letter or a collection of letters, possibly characteristic of the issuer of the security document made from the paper according to the invention.

A grid may be easily produced by photogravure from an image, the apertures of this grid corresponding to the vellum miniregions of the screened region of the paper.

A grid may be made from an array of elementary masks, the elementary masks being joined together by narrow bridges.

The array may also be produced in a one-piece form, for example by cutting or etching a thin metal plate or a sheet of plastic. It may also be produced from photosensitive compounds, such as photocrosslinkable polymers, these being deposited for example on the wire, the parts forming the apertures being protected from radiation and removed by dissolving them in a solvent.

The array preferably consists of a flat metal grid fixed to the outer face of the wire, that is to say the face that is in contact with the suspension of the paper fiber composition.

During the paper-forming phase, each elementary mask limits the accumulation of the constituents of the composition, especially the fibers in suspension, at the wire and creates a miniregion of reduced thickness, and therefore reduced opacity, in the paper region lying in line with this elementary mask.

The bridges create linking portions that also form miniregions of reduced thickness on the sheet. When the elementary masks and the linking points are made in a one-piece form, such a portion of reduced thickness that is isolated from the others does not exist.

It is also possible to produce the array of masks within the thickness of the wire, by locally blocking off the pores thereof. In particular, photosensitive compounds may be used according to the method explained above.

In an alternative embodiment, the array of masks is replaced with an apertured plate, this grid being obtained from a screened image that is computer-generated.

The invention also aims to propose a security document protected against two-sided reproduction by photocopying or by scanning.

It therefore proposes a security document protected against two-sided reproduction by printed indicia on the front side and the reverse side, these indicia forming patterns that can be observed in reflected light and said patterns being designed so as to make up a final representation that can be observed in transmitted light, which document is characterized in that it comprises, as medium, a paper with a screened region as described above and in that the indicia are printed on the front side and on the reverse side of said screened region.

Thanks to this screened region of reduced opacity, the front side/reverse side registration of the printed indicia that are made therein may be facilitated, and complex and/or fine patterns may be obtained that can be readily observed when held up to the light.

Preferably, said printed indicia comprise fine lines produced on the front side and on the reverse side in said screened region in order to form patterns that can be observed in reflected light, said patterns being superposed or arranged so as to make up a final representation that can be observed in transmitted light. Such printing embodiments have been described in the French patent application filed on Jul. 19, 2002 under the filing number FR 02/09221.

More particular, at least some of said lines on the front side and on the reverse side have a width of 110 μm or less, preferably 100 μm or less.

Preferably, the final representation observable in transmitted light presents a relief or volume effect (3D effect) obtained by the variations in density and intensity of the lines.

One way of producing the lines may be to print the lines such that two adjacent lines of the image are always on one side and its next line is on the other side.

More generally, another way may be to print, by means of algorithms, series of lines on one side and their complements on the other. The sets of lines on the front and reverse sides may be determined by mathematical means, encryption, etc.

The image to be observed in transmitted light may be an image as such, but also part of a larger image or portrait, and in particular one already existing on the document.

More particularly, the printed indicia are black lines and/or lines of different shades of gray and/or colored lines and/or lines that change appearance with the viewing angle or through the action of a source of excitation, such as radiation, especially fluorescent, thermochromic or photochromic lines, and/or have electromagnetic, especially electrically conducting, magnetic or of magnetic-resonance, properties.

The document may also comprise printed indicia of flat tint.

More particularly, the invention is aimed at a banknote obtained with a security paper or document as described above. Of course, the security document may comprise other security elements, especially a security thread, flakes, iridescent printing, a watermark, etc.

Examples of the embodiment of such a security document will now be described.

According to a first example, the portrait of a man with a beard, limited to the central part of his face, i.e. the mouth, nose and part of the beard, is printed in the screened region of a paper obtained as described above.

Such an image is formed from lines; a set of lines is printed on the reverse side and the complementary set on the front side so as to constitute the portrait that can be observed when held up to the light.

The image is formed from lines that vary in width and in density, some of the lines having a width of 100 μm. The relief and the volume effect is obtained by the variations in density and intensity of the lines.

These lines are printed by means of a printing machine used to printed banknotes and documents of value.

These machines can print both sides of a paper with perfect registration with respect to one another something that an office printer (after scanning) or a photocopier can accomplish only with limited precision. The front side/reverse side printing registration of the portrait makes it possible to obtain a sharp and high-quality image that can be observed in transmitted light.

If a counterfeiter attempts two-sided photocopying of this image, he will not succeed in bringing the two sides of the photocopy into precise registration and therefore the image will no longer be clearly apparent—there will then be a mass of lines and the image will no longer be visible in transmitted light.

The man in the street may thus readily and immediately see that the document or banknote has been counterfeited.

According to a second example, a fine grid is produced by printing in the screened region of a paper obtained as described above, with a grid on one side of the region and the same grid on the reverse side. Since the two-sided printing is in registration with an extremely high level of precision on machines dedicated to the printing of banknotes and security documents, the front side and reverse side grids are in superposition and only a single grid will appear when this is observed in transmitted light and also in reflected light.

If a counterfeiter reproduces these grids by means of a copier or a printer (after scanning), there will be a shift of a bar or some of the bars and therefore the grid resulting from the superposition of the two, front side and reverse side, grids will become a mass of lines or even a black square, although when observed in reflected light a grid would be seen on the front side or on the reverse side. The man on the street can thus easily and immediately see that the document or banknote has been counterfeited.

The invention claimed is:

1. A printable security paper comprising:

a first paper portion which is a vellum part having a first paper thickness defined between a front side and a reverse side of said paper, a second paper portion which is a continuous screened region capable of receiving printed indicia on a front side and on a reverse side of said screened region which are observable in reflected light and form an image observable in transmitted light, as security element protecting against two-sided copying, wherein the screened region has an average overall opacity less than an opacity of the vellum part of the paper, said screened region consisting of alternations of (i) vellum paper miniregions, having an approximately constant paper thickness defined between the front side and the reverse side of the paper and equal to the first paper thickness of the vellum part of the paper, and (ii) reduced opacity paper miniregions, having a smaller paper thickness defined between the front side and the reverse side of the paper, as compared to the vellum paper miniregions, said paper miniregions being of reduced opacity because of their smaller thickness as compared to the vellum paper miniregions, and printed indicia on the front side and on the reverse side of the screened region of said security paper, wherein these indicia form patterns that are observed in reflected light and said patterns make up a final representation that is observed in transmitted light through said screened paper region.

2. The paper as claimed in claim 1, wherein the smallest dimension of said screened region is at least 0.5 cm.

3. The paper as claimed in claim 1, wherein the difference in opacity between the average overall opacity of said screened region and the opacity of a vellum part of the rest of the paper is between 5 and 12 points the opacity being measured according to the ISO 2471 standard.

4. A security document protected against two-sided reproduction, comprising:

a medium comprising a security paper as claimed in claim 1.

5. The security document as claimed in claim 4, wherein the printed indicia comprise fine lines present both on the front side and on the reverse side of said screened region.

6. The security document as claimed in claim 5, wherein at least some of the lines, on the front side and on the reverse side, have a width of 110 μm or less.

7. The security document as claimed in claim 5, wherein the lines are of variable density and variable intensity so that the final representation that can be observed in transmitted light exhibits a relief and volume effect.

8. The document as claimed in claim 4, wherein the printed indicia are black lines and/or lines of different shades of gray and/or colored lines and/or lines that change appearance with the viewing angle or through the action of a source of excitation, and/or have electromagnetic properties.

9. The document as claimed in claim 4, wherein the screened region and/or the screen of said region forms a customized pattern or a pattern that corresponds to that of the final representation, resulting from the patterns that are printed on the front side and on the reverse side.

10. The document as claimed in claim 4, characterized in that it has a high resistance to circulation.

11. A banknote comprising a security paper as claimed in claim 1.

12. The paper as claimed in claim 2, wherein the difference in opacity between the average overall opacity of said screened region and the opacity of a vellum part of the rest of the paper is between 5 and 12 points, the opacity being measured according to the ISO 2471 standard.

13. The security document as claimed in claim 6, wherein the lines are of variable density and variable intensity so that the final representation that can be observed in transmitted light exhibits a relief and volume effect.

14. The document as claimed in claim 5, wherein the printed indicia are black lines and/or lines of different shades of gray and/or colored lines and/or lines that change appearance with the viewing angle or through the action of a source of excitation, and/or have electromagnetic properties.

15. The document as claimed in claim 6, wherein the printed indicia are black lines and/or lines of different shades of gray and/or colored lines and/or lines that change appearance with the viewing angle or through the action of a source of excitation, and/or have electromagnetic properties.

16. The document as claimed in claim 7, wherein the printed indicia are black lines and/or lines of different shades of gray and/or colored lines and/or lines that change appearance with the viewing angle or through the action of a source of excitation, and/or have electromagnetic properties.

17. The document as claimed in claim 5, wherein the screened region and/or the screen of said region forms a customized pattern or a pattern that corresponds to that of the final representation, resulting from the patterns that are printed on the front side and on the reverse side.

18. The document as claimed in claim 6, wherein the screened region and/or the screen of said region forms a customized pattern or a pattern that corresponds to that of the final representation, resulting from the patterns that are printed on the front side and on the reverse side.

19. The document as claimed in claim 7, wherein the screened region and/or the screen of said region forms a customized pattern or a pattern that corresponds to that of the final representation, resulting from the patterns that are printed on the front side and on the reverse side.

20. The document as claimed in claim 8, wherein the screened region and/or the screen of said region forms a customized pattern or a pattern that corresponds to that of the final representation, resulting from the patterns that are printed on the front side and on the reverse side.

21. The paper as claimed in claim 1, wherein the difference in opacity between the average overall opacity of said screened region and the opacity of a vellum part of the rest of the paper is between 6 and 10 points, the opacity being measured according to the ISO 2471 standard.

22. The paper as claimed in claim 2, wherein the difference in opacity between the average overall opacity of said screened region and the opacity of a vellum part of the rest of the paper is between 6 and 10 points, the opacity being measured according to the ISO 2471 standard.

23. The paper as claimed in claim 1, wherein the vellum miniregions and the reduced opacity miniregions are arranged to form a grid.

24. The paper as claimed in claim 1, wherein the reduced opacity miniregions are connected by reduced opacity bridges having a narrower width than a width of the reduced opacity miniregions.

25. The paper as claimed in claim 1, wherein the reduced opacity miniregions are isolated from each other.

* * * * *